United States Patent [19]

Upham

[11] Patent Number: 4,733,597

[45] Date of Patent: Mar. 29, 1988

[54] SEQUENTIAL LAUNCHING SYSTEM

[75] Inventor: Theadore E. Upham, Jackson, Mich.

[73] Assignee: Sparton Corporation, Jackson, Mich.

[21] Appl. No.: 34,765

[22] Filed: Apr. 6, 1987

[51] Int. Cl.[4] ..... F41F 5/02; B64D 1/04

[52] U.S. Cl. ..... 89/1.51; 89/1.806

[58] Field of Search ..... 89/1.51, 1.53, 1.57, 89/1.58, 1.816, 1.818, 1.8; 102/351, 352, 406, 357

[56] References Cited

U.S. PATENT DOCUMENTS

| | | | |
|---|---|---|---|
| 3,451,306 | 6/1969 | Lagerstrom et al. | 89/1.51 X |
| 3,662,645 | 5/1972 | Thurston et al. | 89/1.51 |
| 3,686,999 | 8/1972 | Francois | 89/1.51 X |
| 4,019,421 | 4/1977 | Ström | 89/1.51 |
| 4,026,188 | 5/1977 | Woodruff et al. | 89/1.51 |
| 4,164,887 | 8/1979 | Ouellette | 89/1.51 |
| 4,263,835 | 4/1981 | Dragonuk | 89/1.51 |
| 4,438,675 | 3/1984 | Fischer et al. | 89/1.51 X |
| 4,444,085 | 4/1984 | Dragonuk | 89/1.51 |

*Primary Examiner*—David H. Brown

*Attorney, Agent, or Firm*—Reising, Ethington, Barnard, Perry & Milton

[57] ABSTRACT

A sequential launching system is disclosed for sonobuoys and the like in which each of a plurality of sonobuoys is provided with a separate launch mechanism. The launch mechanism comprises a piston and piston chamber at the aft end of the sonobuoy. The cross-sectional area of the piston chamber is substantially smaller than that of the launch tube and air flow passages are provided for allowing ambient air to flow to the aft end of the sonobuoy to equalize the air pressure with that at the forward end. Air passages around the plural sonobuoys are provided by longitudinally extending, radially spaced ribs which extend from the muzzle end to the breech end of the launch tube. The ribs serve to support and guide the sonobuoys in the launch tube.

8 Claims, 4 Drawing Figures

Fig-1
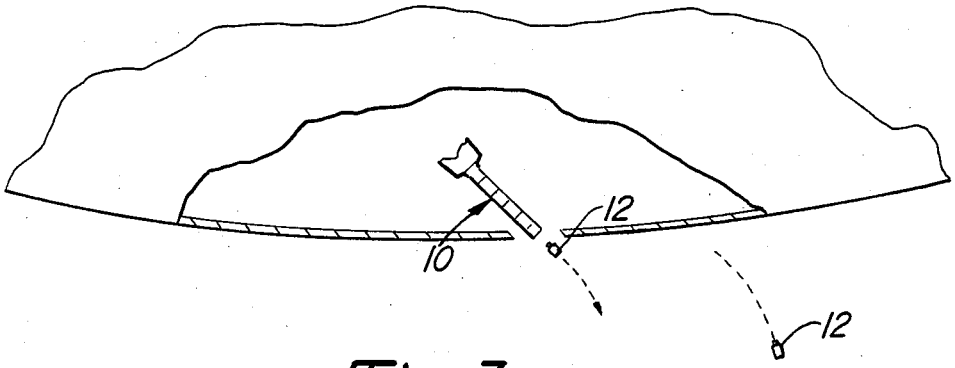
Fig-3
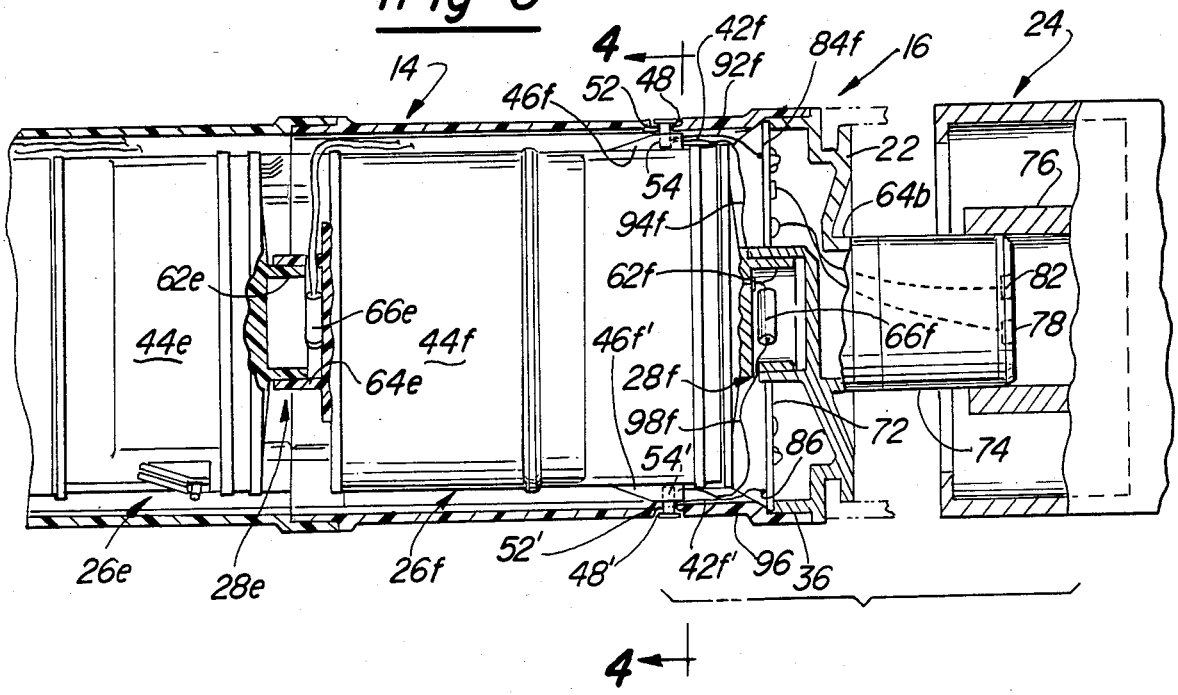
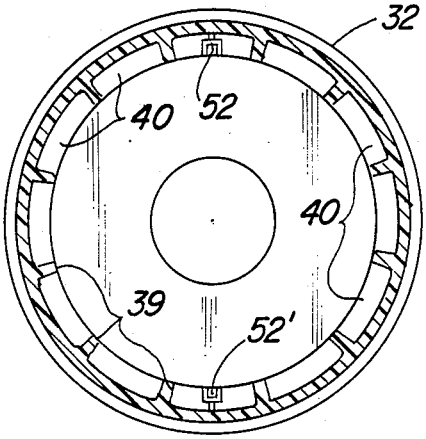
Fig-4

SEQUENTIAL LAUNCHING SYSTEM

FIELD OF THE INVENTION

This invention relates to launching systems for deployable devices such as sonobuoys; more particularly, it relates to a sequential launching system.

BACKGROUND OF THE INVENTION

It is a common practice to deploy sonobuoys and other devices from aircraft launching systems to place them in remote locations for detection and signaling purposes. For example, sonobuoys are deployed in remote parts of the ocean for oceanographic survey purposes. In prior practice, a single sonobuoy is ejected from a launching tube by a propulsion device such as a compressed gas cartridge. The launching tube served as a storage container for the sonobuoy as well as a tube for launching the sonobuoy from an aircraft. Certain standard sizes of sonobuoys evolved and the typical larger size is about three feet in length and five inches in diameter. In order to launch a sonobuoy of such size with sufficient velocity to clear the aircraft, a diaphragm is attached to the rear end of the sonobuoy so that the explosive cartridge causes a pressure build-up to eject the sonobuoy from the tube. For this purpose, a sealing relationship is provided between the wall of the tube and the body of the sonobuoy to contain the gas pressure until the sonobuoy has been accelerated to ejection velocity. The acceleration is resisted by the inertia of the sonobuoy as well as the atmospheric air pressure in the muzzle end of the launching tube.

More recent developments in the design and application of sonobuoys have resulted in sonobuoys of much smaller size. It has become desirable, in some applications, to deploy several sonobuoys of relatively small size from a single launching tube. For this purpose, it is known to use a launching tube of the standard size previously used for large sonobuoys and to load several small sonobuoys into the tube for sequential launching. Such a sequential sonobuoy launching system is disclosed in the Woodruff et al U.S. Pat. No. 4,026,188 granted May 31, 1977. In this system, a plurality of similar sonobuoys are loaded in a single launching tube in an end-to-end relationship between the muzzle end and the breech end of the launching tube. A closed bulkhead is provided at the breech end and a separate launching mechanism is provided for each of the sonobuoys. The launching mechanism for each sonobuoy is disposed between its aft end and the forward end of the adjacent sonobuoy, except for the sonobuoy adjacent the bulkhead; for it, the launching mechanism is disposed between the aft of the sonobuoy and the bulkhead. Each launching mechanism comprises a compressed gas cartridge and an explosive squib for piercing the cartridge when actuated by an electrical signal. An electric circuit is provided for actuating the launching mechanisms separately so that the sonobuoys may be ejected from the launching tube one at a time. At the forward end of each sonobuoy is a bulkhead which cradles the sonobuoy and engages the inner cylindrical surface of the launching tube to form a substantially gas tight seal. The aft end of each sonobuoy is cradled by an aft bulkhead which also forms a substantially gas tight seal with the periphery of the launching tube. This arrangement is said to facilitate the launching of a sonobuoy, in that it tends to contain the gas pressure released from the explosive cartridge until the sonobuoy leaves the muzzle of the launching tube.

A similar arrangement for sequential launching of plural sonobuoys is shown in the Ouellette U.S. Pat. No. 4,164,887 granted Aug. 21, 1979. In this system, a firing module is positioned behind each of the buoys. The firing module includes a cup-shaped member with a compressed gas cartridge and firing squib therein. An apertured spacer disk is disposed over the cup-shaped member and is held by stops extending through the wall of the launching tube. The aperture in the spacer disk is said to permit gas from the cartridge to completely fill the region between the module and the sonobuoy to eject it from the launching tube.

A general object of this invention is to provide an improved propulsion means for expelling individual units from a launch tube and to overcome certain disadvantages of the prior art.

SUMMARY OF THE INVENTION

In accordance with this invention, an improved launching system is provided in which the launching force is generated by a piston and piston chamber at the aft end of a container to be launched. The cross-sectional area of the piston chamber is substantially smaller than that of the launch tube and means are provided for allowing ambient air to flow to the aft end of the container tending to equalize the air pressure thereon with that at the forward end. Preferably, a piston and cylinder arrangement is used with a small bore and small stroke compared with the diameter and length of the container.

Further, in accordance with this invention, the sequential launching system is provided with a launch tube with a plurality of generally cylindrical containers to be launched disposed in end-to-end relationship within the tube between the muzzle end and a bulkhead at the breech end. A separate launching mechanism is provided for each container. The launching mechanism comprises a piston and a piston chamber in slideable mating relation and means for producing an expanding gas in said chamber for launching the associated container. The chamber has a smaller cross-sectional area than that of the launching tube and means are provided for allowing ambient air to flow to the aft end of the container. Preferably, the launch tube is provided with a plurality of axially extending lands on the inner surface for guiding the container and air passages are provided between the lands and extend from the muzzle end to the breech end to allow ambient air to flow to the aft end of the containers.

A complete understanding of this invention may be obtained from the detailed description that follows taken with the accompanying drawings.

DESCRIPTION OF THE DRAWINGS

FIG. 1 depicts a sonobuoy launching tube in an aircraft;

FIG. 3 is a cut-away view of the aft end of a launching tube and sonobuoys disposed therein;

FIG. 4 is a view taken on line 4—4 of FIG. 3.

BEST MODE FOR CARRYING OUT THE INVENTION

Figure 2:
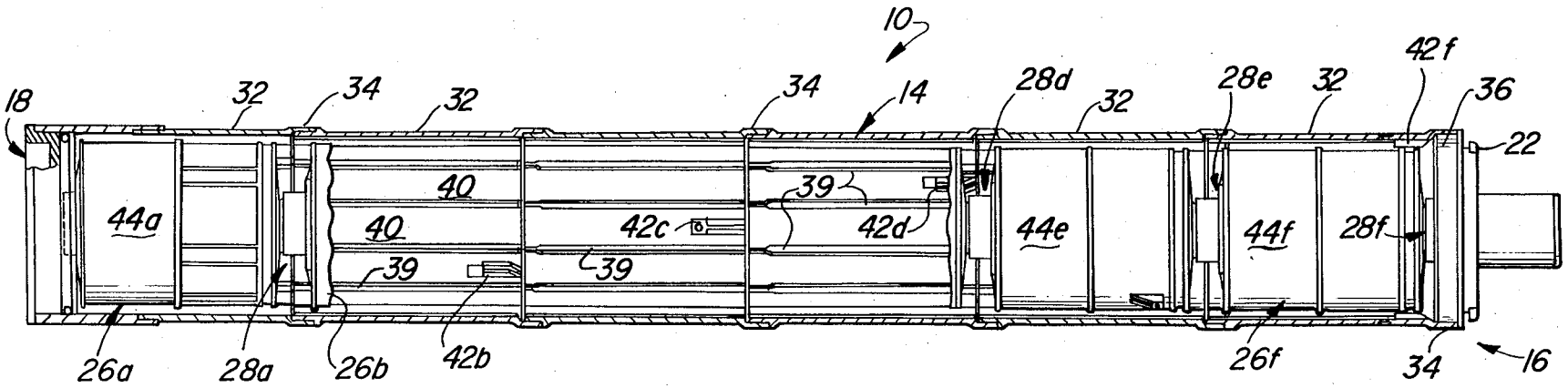
FIG. 2 is a cross-sectional view of a launching tube.

Referring now to the drawings, there is shown an illustrative embodiment of the invention in a sequential launching system for sonobuoys. It will be appreciated, as the description proceeds, that the invention is useful in other applications and may be realized in other embodiments.

FIG. 1 shows a launching tube 10 in accordance with this invention as it is installed within the fuselage of an aircraft for deploying a plurality of sonobuoys 12. The launching tube 10, as shown in FIG. 2, comprises a cylindrical tube 14 having a fixed bulkhead 16 at its breech end and a breakout cap 18 at its muzzle end. A breech member 22, suitably having a bayonet fitting is provided for coupling the launch tube 10 with a launch fitting 24 on the aircraft. A plurality of sonobuoys 26*a*, 26*b*, 26*c* (not shown), etc. are disposed in end-to-end relationship between the breakout cap 18 and the bulkhead 16 in the cylindrical tube 14. A separate launching mechanism is provided for each of the sonobuoys and all of them are of the same construction. Launching mechanisms 28*a*, 28*d*, 28*e* and 28*f* are shown in FIG. 2. The construction of the launching mechanism will be described in detial subsequently.

The cylindrical tube 14 is suitably constructed of plastic and is comprised of a plurality of cylindrical sections 32. The sections 32 are connected together by suitable end fittings 34 which are joined by a suitable adhesive. The aft end or breech end of the cylindrical tube 14 is closed by the bulkhead 16 which includes a cylindrical flange 36 which is telescopically fitted within the end fitting 34 and secured thereto. The bulkhead 16 serves as a reaction member which is fixed to the cylindrical tube 14 to transfer the impulses resulting from the firing of the launching mechanisms 28 to the supporting structure. The forward or muzzle end of the cylindrical tube 14 is closed by the breakout cap 18 which is telescopically fitted into the tube and retained by a set of shear pins (not shown) so that the launch tube 10 is sealed for storage and transport purposes. When the first sonobuoy 26*a* is launched, the impact thereof against the breakout cap 18 breaks it away from the tube and the cap is jettisoned. The cylindrical tube 14 is provided on its interior periphery with a set of longitudinally extending, circumferentially spaced ribs or lands 39. The lands 39 extend from the muzzle end to the breech end of the cylindrical tube 14 and they serve as support and guide surfaces for the sonobuoys 26. The lands 39 define a plurality of axially spaced channels 40 which serve as air passages extending from the muzzle end of the cylindrical tube 14 to the breech end thereof and hence to the aft end of each of the sonobuoys, for purposes to be described subsequently.

To retain each of the sonobuoys in position prior to launch, a pair of holding members is provided on the wall of the cylindrical tube 14 for each sonobuoy. In particular, a pair of holding members 42*f* and 42*f'* is provided for sonobuoy 26*f* at diametrically opposite locations on the wall of the cylindrical tube 14. Each of the holding members 42*f* and 42*f'* is provided with a hole extending therethrough and also through the wall of the tube 14 with a metal eyelet 48 disposed in the hole. The eyelet 48 is adapted to receive a metal shear pin 52 for purposes to be described presently. Similarly, holding members 42*d*, 42*c* and 42*b* are shown for the other sonobuoys. It is noted that the pairs of holding members are positioned between the lands 39 and successive pairs of holding members are angularly displaced by thirty degrees relative to each other in progression along the length of the cylindrical tube 14. The holding members 42*a*–42*f* will be described in greater detail subsequently.

Each of the sonobuoys comprises a generally cylindrical container which houses the various components of the sonobuoy. For example, the sonobuoy 26*f* comprises a cylindrical container 44*f*. The cylindrical container of the sonobuoy is supported within the cylindrical tube 14 on the lands 36. Each sonobuoy is provided with a pair of holding members at diametrically opposite positions on the respective container. Sonobuoy 26*f*, for example, is oriented within the cylindrical tube 14 so that its holding members 46*f* and 46*f'* are positioned respectively opposite the holding members 42*f* and 42*f'* on the cylindrical tube. The holding member 46*f* (and also member 46*f'*) is provided with a recess having a metal eyelet 54 therein adapted to receive the inner end of the shear pin 52. Similarly, a pair of shear pins 52 for each of the sonobuoys hold the sonobuoy in position relative to the cylindrical tube 14 with the rear end of the holding member carried by the sonobuoy in abutment with the holding member 42*f* on the cylindrical tube 14. The shear pins 52 are adapted to be sheared off by the impulse imparted to the sonobuoy by the firing of the respective launching mechanism whereby the sonobuoy is free to be ejected from the launch tube. The metal eyelets and shear pin also serve as an electrical terminal for the electrical circuit connected to the launching mechanisms, as will be described subsequently.

Construction of the launching mechanism will be described with reference to the launch mechanism 28*e* as shown in FIG. 3. The launching mechanism 28*e* comprises, in general, a piston 62*e*, a piston chamber or cylinder 64*e* and an electrically fired gas cartridge 66*e*. The cylinder 64*e* is mounted on the forward end of the sonobuoy 26*f* and is formed as a unitary annular wall or sleeve protruding from the end wall of the forward end wall of the container 44*f* of the sonobuoy. The piston 62*e* is mounted on the aft end of the sonobuoy 26*e* and may be formed as an annular wall or sleeve unitary with and protruding rearwardly from the rear wall of the container 44*e* of the sonobuoy. The piston 62*e* is diposed in slideable mating engagement with the cylinder 64*e* to provide a substantial degree of gas sealing of the chamber. The electrically fired gas cartridge 66*e* is adapted to produce an expanding gas pressure in the cylinder 64*e* in response to an electrical signal. It is suitably comprised of a cartridge filled with compressed carbon dioxide gas which is punctured by an explosive squib in response to an electric signal. An electrical circuit which will be described subsequently is provided for firing each of the launching mechanisms separately.

The launching mechanism 28*e*, as just described, has a cylinder or propellant chamber which has a cross-sectional area which is substantially smaller than the cross-sectional area of the launching tube. It has a power stroke, taken as the length of the piston inserted into the cylinder, which is substantially smaller than the length of the container of the sonobuoy. The sonobuoy is accelerated from its static position, as held by the shear pins, to its launch velocity during the power stroke. This is accomplished with a relatively small propellant capacity in the launching mechanism because the air pressure at the aft end of the sonobuoy and surrounding the launching mechanism is maintained at the ambient air pressure in the forward end of the launch tube. This is provided by air flow through the channels 40 around the sonobuoy to the aft end thereof. As a result, the air pressure at the aft end of the sonobuoy during acceleration is substantially equal to that at the muzzle end of the launch tube and the acceleration of the sonobuoy is not opposed by ambient air pressure. Substantially all of the energy produced by the propellant is imparted to the sonobuoy and the amount dissipated to the surrounding air is minimized. With this arrangement, the diameter of the cylinder 64*e* is substantially less (suitably less than one-half) than the diameter of the launch tube. Further, the stroke, i.e. the length of the piston 62*e* which is inserted into the cylinder 64*e*, is suitably smaller than the diameter of the cylinder 64*e*. The shock imparted to the sonobuoy at launch may be adjusted by adjusting the length of the stroke.

As mentioned above, an electronic circuit is provided for firing the launching mechanisms for sequential launching of the respective sonobuoys. The electronic circuit includes a circuit board 72 which is mounted in the end fitting at the aft end of cylindrical tube 14 adjacent the bulkhead 16. Electrical power and control signals are supplied to the launch tube 10 from the aircraft through the launch fitting 24. For this purpose, an electrical connector plug 74 of cylindrical configuration is mounted on the bulkhead 16. The plug 74 mates with a receptacle 76 in the launch fitting 24 and an electrical ground connection is provided by conductive sleeves on the exterior of the plug 74 and the interior of receptacle 76. The plug 74 is provided with the power supply contact 78 and is connected by a conductor to the circuit board 72. Similarly, the plug 74 is provided with a signal contact 82 which is connected with the circuit board 72. The circuit board is provided with a separate signal output terminal for each of the firing mechanisms and it is also provided with a single common ground terminal. For the sonobuoy 26*f*, as shown in FIG. 3, the signal output terminal 84*f* is provided and, for all of the sonobuoys, a common ground contact 86 is provided. The electrically fired gas cartridge of the launching mechanism 28*f* is connected to the signal terminal 84*f* by a pair of wires 92*f* and 94*f* which are electrically connected through the shear pin 52 at stop members 42*f* and 46*f*. For this purpose, the wire 92*f* is welded to the eyelet 48 and the wire 94*f* is welded to the eyelet 54. The wire 94*f* extends to one terminal of the cartridge in the launching mechanism 28*f*. A similar wiring connection is provided to connect the common ground terminal 86 on the circuit board through the wires 96 and 98*f* through the shear pin 52'. The wire 98*f* is connected with the ground return terminal of the cartridge in the launching mechanism 28*f*. The remaining launching mechanisms 28*a*, 28*b*, 28*c*, etc. are similarly connected between the respective signal output terminals on the circuit board and the common ground terminal on the circuit board. The circuit board is provided with a suitable electronic multiplexing circuit and amplifying stage for applying firing pulses sequentially to the respective signal output terminals on the circuit board in response to successive input signals on the signal contact 82 from the computer or other controller on board the aircraft. Accordingly, the sonobuoys 26*a* through 26*f* are sequentially fired, in that order, at desired or controlled time intervals.

Although the description of this invention has been given with reference to a particular embodiment, it is not to be construed in a limiting sense. Many variations and modifications of the invention will now occur to those skilled in the art. For a definition of the invention reference is made to the appended claims.

What is claimed is:

1. In a sequential launching system of the type comprising a launch tube having a breech end and a muzzle end, a closed bulkhead at the breech end of said tube, a plurality of generally cylindrical containers to be launched from said tube and being disposed in end-to-end relationship within said tube between said bulkhead and said muzzle end, a separate propulsion means for each container with a first propulsion means for acting between said bulkhead and the aft end of the adjacent container and an additional propulsion means for acting between each adjacent pair of containers, whereby said containers may be launched sequentially, the improvement which comprises:

means for allowing ambient air to flow to the aft end of each container, and wherein:

each of said propulsion means includes a piston and a piston chamber, said piston being in slideable mating relation with said chamber, means for producing expanding gas in said chamber for launching the container which is forward of the respective propulsion means, said chamber having a smaller cross-sectional area than that of said tube.

2. The invention as defined in claim 1 wherein said means for allowing ambient air to flow comprises a plurality of axially extending lands on the inner surface of said tube for guiding said containers with air passages between said lands and extending from the muzzle end to the breech end of said tube.

3. The invention as defined in claim 1 wherein, for each of said additional propulsion means, said piston and said piston receiver are disposed respectively on the aft end and the forward end of adjacent containers.

4. The invention as defined in claim 3 wherein said means for producing fluid pressure comprises a gas pressurized cartridge disposed in said chamber and responsive to an electrical signal for producing fluid pressure in said chamber.

5. The invention as defined in claim 3 wherein, in said first propulsion means, said piston chamber and said piston are disposed respectively on said bulkhead and on the aft end of the container adjacent said bulkhead.

6. The invention as defined in claim 1 wherein said tube is cylindrical, said piston and piston chamber are also cylindrical and define a cylindrical chamber, said cylindrical chamber having a diameter which is substantially smaller than the diameter of said tube.

7. The invention as defined in claim 6 wherein the diameter of said chamber is less than one-half of the diameter of said tube.

8. The invention as defined in claim 7 wherein the length of said piston inside said piston chamber is less than the diameter of said cylindrical chamber.

* * * * *